US012302971B2

(12) United States Patent
Varadan

(10) Patent No.: US 12,302,971 B2
(45) Date of Patent: May 20, 2025

(54) SYSTEM AND METHOD FOR FORMING A GARLAND

(71) Applicant: Lakshmanan Varadan, Markham (CA)

(72) Inventor: Lakshmanan Varadan, Markham (CA)

( * ) Notice: Subject to any disclaimer, the term of this patent is extended or adjusted under 35 U.S.C. 154(b) by 0 days.

(21) Appl. No.: 17/845,523

(22) Filed: Jun. 21, 2022

(65) Prior Publication Data

US 2023/0404193 A1 Dec. 21, 2023

(51) Int. Cl.
*A41G 1/04* (2006.01)
*D02G 3/38* (2006.01)

(52) U.S. Cl.
CPC ..... *A41G 1/04* (2013.01); *D02G 3/38* (2013.01)

(58) Field of Classification Search
CPC ... A41G 1/04; A41G 1/00; A41G 1/02; D02G 3/38
See application file for complete search history.

(56) References Cited

U.S. PATENT DOCUMENTS 1,049,857 A * 1/1913 Hendschuch ..... D07B 7/14 242/439.6
1,210,001 A * 12/1916 Randall ..... D07B 7/14 57/15
1,253,035 A * 1/1918 Hoffman ..... A41G 1/00 156/185
1,526,572 A * 2/1925 William ..... H01B 13/282 242/441.2
1,585,357 A * 5/1926 Anderson ..... D04D 3/00 57/24
1,788,641 A * 1/1931 Sunderland ..... D07B 3/06 57/361
2,105,338 A * 1/1938 Sunderland ..... D07B 3/06 57/361
2,197,615 A * 4/1940 Kelman ..... A41G 1/04 428/7
2,386,172 A * 10/1945 Wisoff ..... A41G 1/04 140/93 R
2,920,364 A * 1/1960 Tulloss ..... D07B 7/02 403/291
2,957,263 A * 10/1960 Rapaport ..... B65B 25/02 242/439
2,993,332 A * 7/1961 Hughes ..... D07B 5/00 493/380
3,138,511 A * 6/1964 Cadwallader ..... F16L 11/08 156/143
3,141,285 A * 7/1964 Benk ..... D07B 7/14 57/15
3,284,995 A * 11/1966 Haight ..... D07B 7/14 242/615

(Continued)

*Primary Examiner* — Bao-Thieu L Nguyen
(74) *Attorney, Agent, or Firm* — Thompson Hine LLP

(57) ABSTRACT

Systems and methods for forming a garland from garland components such as flowers and greenery, where a core rope is retained against a drive roller at a first position, and a rotating cross member supports a spool of binding thread. The rotating cross member rotates the spool around the core rope to wind the binding thread around the core rope to secure one of the garland components against the core rope, and the drive roller then displaces the core rope to a second position to enable the binding thread to secure another of the garland components against the core rope adjacent the first garland component, forming the garland.

12 Claims, 12 Drawing Sheets

(56) References Cited

U.S. PATENT DOCUMENTS 3,331,727 A * 7/1967 Lieval ..... A47G 33/06 425/317
3,344,592 A * 10/1967 Geisinger ..... F16L 11/10 57/3
3,590,567 A * 7/1971 Bonikowski ..... D07B 7/14 242/421.7
3,657,870 A * 4/1972 Marks ..... A46B 3/18 428/18
3,827,225 A * 8/1974 Schoerner ..... B65H 57/18 57/58.34
3,852,868 A * 12/1974 Rodermund ..... A41G 1/04 428/10
4,516,394 A * 5/1985 Bell ..... D02G 3/36 57/902
4,549,391 A * 10/1985 Toda ..... D07B 3/06 57/15
4,640,086 A * 2/1987 Levino ..... B29C 63/105 57/3
4,663,928 A * 5/1987 Delobel ..... H01B 13/26 57/264
5,517,812 A * 5/1996 Simmons ..... H01B 13/26 57/235
6,260,342 B1 * 7/2001 Lehman ..... A41G 1/04 87/8
6,519,924 B1 * 2/2003 Barz ..... A01G 5/02 57/10
9,487,887 B1 * 11/2016 Grossman ..... D03D 51/00
11,155,938 B2 * 10/2021 Shibuya ..... H01B 13/0214
11,905,135 B1 * 2/2024 Sims ..... D02J 13/00
2007/0278339 A1 * 12/2007 McMahan ..... F41B 5/14 57/237
2019/0119833 A1 * 4/2019 Hefele ..... B65H 51/20
2019/0127893 A1 * 5/2019 Tao ..... D01H 7/926
2020/0277713 A1 * 9/2020 Shibuya ..... B21F 17/00

* cited by examiner

SYSTEM AND METHOD FOR FORMING A GARLAND

TECHNICAL FIELD OF THE INVENTION

The present invention relates to methods for forming garland lengths.

BACKGROUND OF THE INVENTION

In the field of garland-making, garland components such as flowers and greenery are tied or otherwise secured to a central cord or rope by a person skilled in the art of making such garlands. A desired garland length is determined, specific garland components are selected, and the garland components are secured to the cord or rope until the desired length is achieved.

However, it is well know that significant technical skill and experience is required of the person making the garland. Further, the actual garland-making process is known to be time-consuming even for those of sufficient skill and experience.

What is needed, therefore, is a means for less-skilled persons to form garlands, and to reduce the required garland-making time for garland makers of all skill and experience levels.

SUMMARY OF THE INVENTION

The present invention is directed to systems and methods for forming a garland, using a core rope, binding thread and garland components, wherein a drive roller is employed to repeatedly axially move a core rope so that a binding thread rotating around the core rope can secure a series of garland components to the core rope.

According to a first broad aspect of the present invention, there is provided a system for forming a garland from a plurality of garland components, the system comprising:

- a drive roller;
- a core rope retained against the drive roller at a first position;
- a rotating cross member;
- at least one spool supported by the rotating cross member, the at least one spool for supplying binding thread;
- the rotating cross member configured to rotate the at least one spool around the core rope, thereby winding the binding thread around the core rope to secure one of the plurality of garland components against the core rope; and
- the drive roller configured to displace the core rope to a second position axially spaced from the first position to enable the rotating cross member to rotate the at least one spool around the core rope to wind the binding thread around the core rope to secure another of the plurality of garland components against the core rope adjacent the one of the plurality of garland components, thereby forming the garland.

In some exemplary embodiments of the first aspect, the system may further comprise a first motor to power the drive roller to displace the core rope, and a second motor to power the rotating cross member. The first motor is preferably a stepper motor directly coupled to the drive roller, and the second motor may also be a stepper motor. In some such exemplary embodiments, the system may further comprise an actuator configured to actuate the first motor and the second motor. Where an actuator is employed, it may comprise a foot pedal switch in communication with the first motor and the second motor.

In some exemplary embodiments employing an actuator, the actuator comprises a user input device and a controller, the user input device configured to allow a user to input garland component type (defining core rope feed length between adjacent garland components and spool rotation degrees) and desired garland length, and the controller configured to instruct the first motor and the second motor.

The rotating cross member preferably supports two spools, the two spools supported at opposite ends of the rotating cross member to simultaneously wind discrete lengths of the binding thread around the core rope.

The plurality of garland components are preferably selected from the group consisting of flowers, greenery and a combination thereof.

Exemplary systems may further comprise a pressure roller adjacent the drive roller, wherein the core rope is retained under pressure between the drive roller and the pressure roller.

According to a second broad aspect of the present invention, there is provided a method for forming a garland from a plurality of garland components, the method comprising the steps of:

a. positioning a core rope at a first location;
b. retaining the core rope against a drive roller;
c. providing at least one spool for supplying binding thread;
d. positioning one of the plurality of garland components against the core rope;
e. rotating the at least one spool around the core rope, thereby winding the binding thread around the core rope to secure the one of the plurality of garland components against the core rope;
f. displacing the core rope to a second position axially spaced from the first position using the drive roller;
g. positioning a second of the plurality of garland components against the core rope adjacent the one of the plurality of garland components; and
h. rotating the at least one spool around the core rope, thereby winding the binding thread around the core rope to secure the second of the plurality of garland components against the core rope, thereby forming the garland.

The plurality of garland components are preferably selected from the group consisting of flowers, greenery and a combination thereof.

In some exemplary embodiments the at least one spool is supported on a rotating cross arm for rotation around the core rope. In some exemplary embodiments the at least one spool is two spools, the two spools supported at opposite ends of the rotating cross member to simultaneously wind discrete lengths of the binding thread around the core rope.

Some exemplary methods further comprise repeating steps f to h until a desired garland length is achieved.

According to a third broad aspect of the present invention, there is provided a system for forming a garland from a plurality of garland components, the system comprising:

- a drive roller powered by a first motor;
- a core rope retained against the drive roller at a first position;
- a rotating cross member powered by a second motor;
- an actuator configured to actuate the first motor and the second motor;
- at least one spool supported by the rotating cross member, the at least one spool for supplying binding thread;

the rotating cross member configured to rotate the at least one spool around the core rope, thereby winding the binding thread around the core rope to secure one of the plurality of garland components against the core rope; and the drive roller configured to displace the core rope to a second position axially spaced from the first position to enable the rotating cross member to rotate the at least one spool around the core rope to wind the binding thread around the core rope to secure another of the plurality of garland components against the core rope adjacent the one of the plurality of garland components, thereby forming the garland.

In some exemplary embodiments the actuator comprises a foot pedal switch operable to activate and deactivate the first motor and the second motor.

In some exemplary embodiments the actuator comprises a user input device and a controller, the user input device configured to allow a user to input garland component type (defining core rope feed length between adjacent garland components and spool rotation degrees) and desired garland length, and the controller configured to instruct the first motor and the second motor.

Exemplary systems may further comprise a pressure roller adjacent the drive roller, wherein the core rope is retained under pressure between the drive roller and the pressure roller.

Exemplary systems may be operable in single cycle mode or repeating cycle mode. In exemplary embodiments operable in single cycle mode, activation of the actuator rotates the at least one spool around the core rope, thereby winding the binding thread around the core rope to secure the one of the plurality of garland components against the core rope, and displaces the core rope to the second position. In exemplary embodiments operable in repeating cycle mode, activation of the actuator repeats the cycle of rotating the at least one spool around the core rope and displacing the core rope.

A detailed description of exemplary embodiments of the present invention is given in the following. It is to be understood, however, that the invention is not to be construed as being limited to these embodiments. The exemplary embodiments are directed to particular applications of the present invention, while it will be clear to those skilled in the art that the present invention has applicability beyond the exemplary embodiments set forth herein.

BRIEF DESCRIPTION OF THE DRAWINGS

In the accompanying drawings, which illustrate exemplary embodiments of the present invention.

Exemplary embodiments will now be described with reference to the accompanying drawings.

DETAILED DESCRIPTION OF EXEMPLARY EMBODIMENTS

Throughout the following description, specific details are set forth in order to provide a more thorough understanding to persons skilled in the art. However, well known elements may not have been shown or described in detail to avoid unnecessarily obscuring the disclosure. The following description of examples of the invention is not intended to be exhaustive or to limit the invention to the precise form of any exemplary embodiment. Accordingly, the description and drawings are to be regarded in an illustrative, rather than a restrictive, sense.

The present invention is directed to machines, systems and methods for forming elongate garlands from garland components such as flowers and greenery (although the skilled person will know that other types of garland components may be used, including without limitation artificial flowers). In embodiments of the present invention, a core rope is retained against a drive roller, and the drive roller is used to axially move the core rope (generally in a downward direction as illustrated), such that an operator can position a first garland component in place against the core rope while binding thread is wound around the core rope to secure the garland component against the core rope, subsequent to which the drive roller repositions the core rope so another garland component can be secured to the core rope next to the previous garland component. The result is a length of garland.

Figure 1:
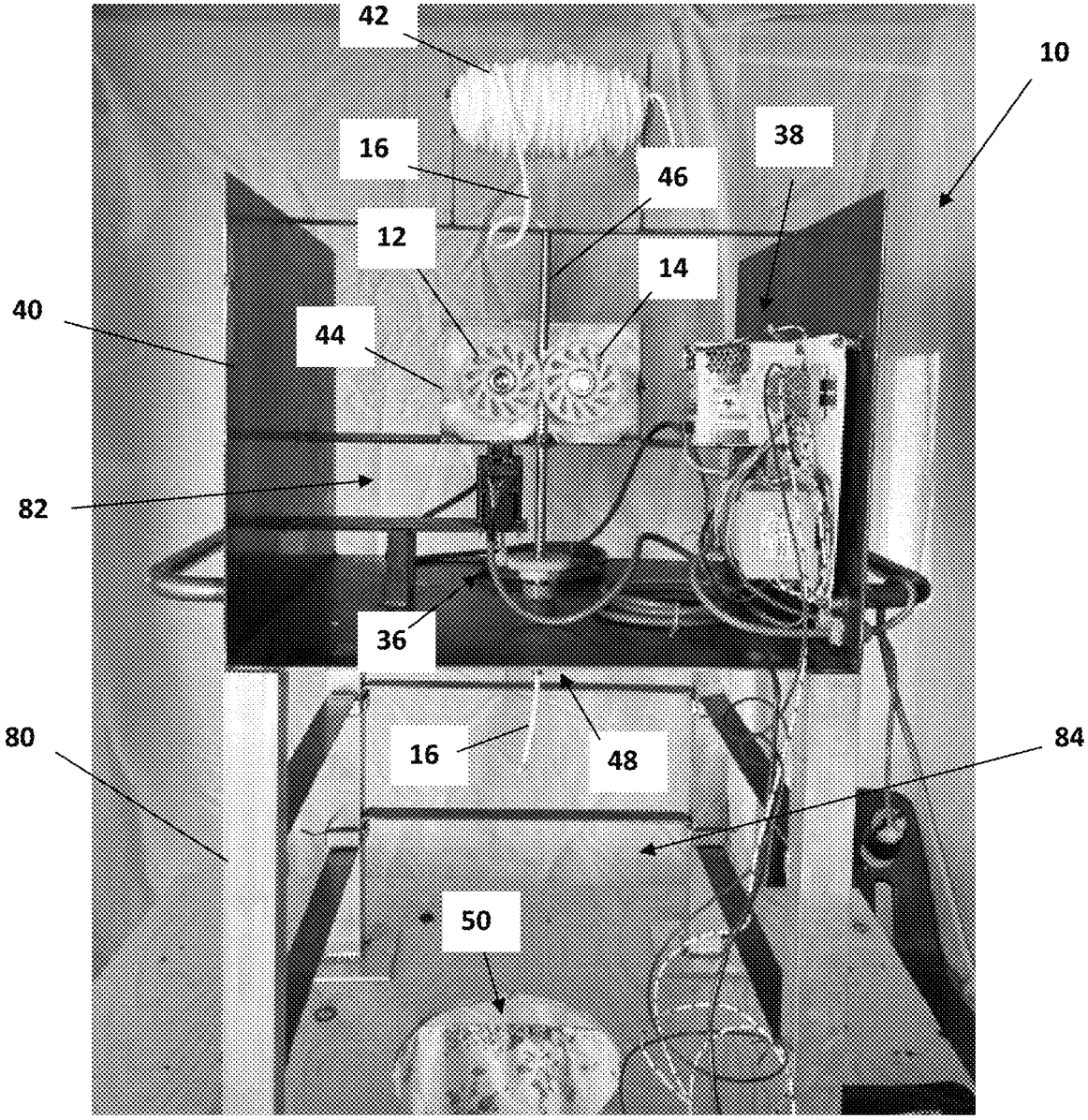
FIG. 1 is a front elevation view of a garland tying machine in accordance with one embodiment of the present invention, with the front panel open to show the drive roller and the pressure roller.

Turning now to FIG. 1, an exemplary garland-forming machine and system 10 is illustrated with the front panel removed to better show internal components such as a programmable logic controller (PLC) 38 and mounting bracket 44. The machine/system 10 comprises a housing 40 supported by legs 80, such that there is an inner space 82 within the housing 40 for retention of mechanical and electronic components, and a work space 84 beneath the housing 40 where the garland will be formed. At the bottom of the work space 84 is an aperture 50 through which the garland will pass as the core rope 16 is lowered and the garland length increases.

Figure 2:
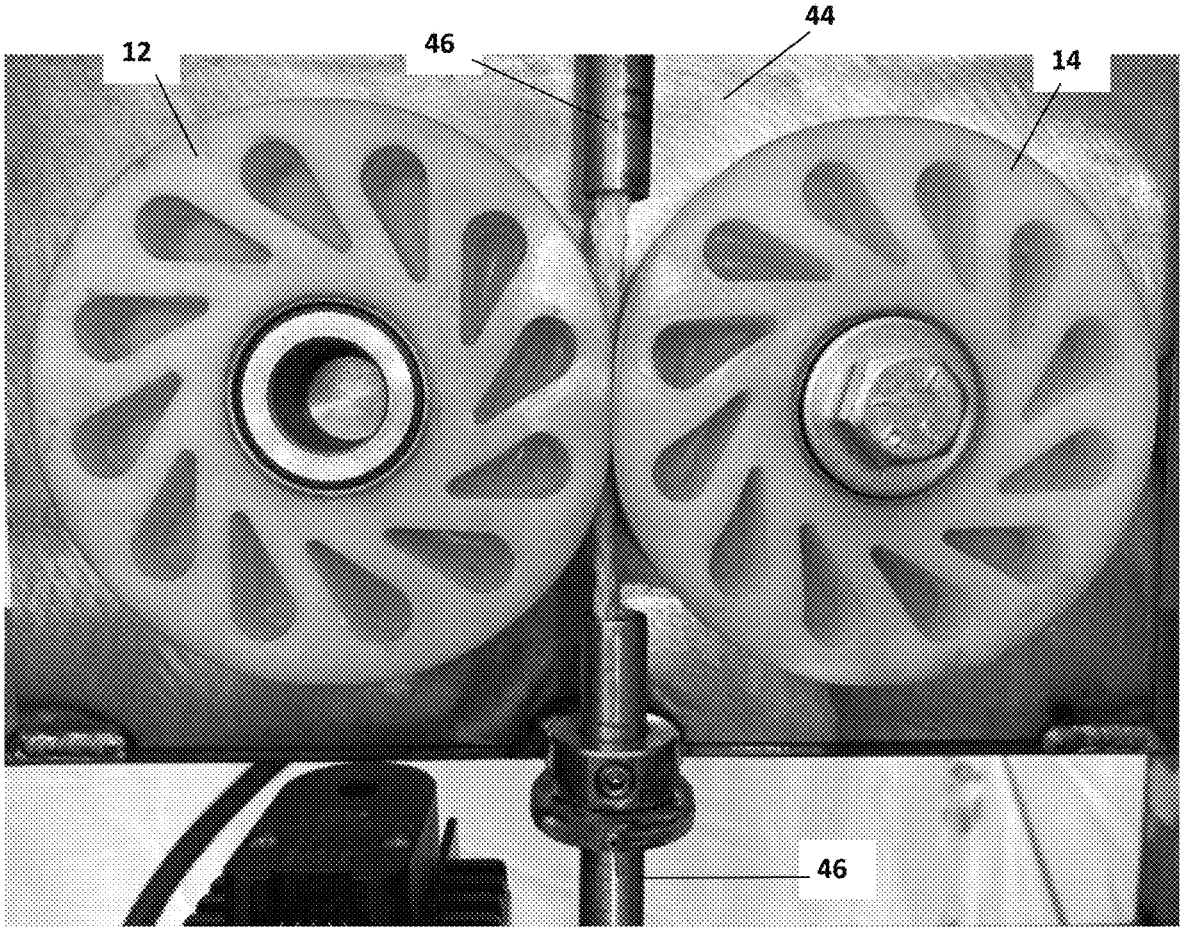
FIG. 2 is a detailed view of the drive roller and pressure roller of the embodiment of FIG. 1.

Within the inner space 82, a drive roller 12 and pressure roller 14 are mounted on the mounting bracket 44. The drive roller 12 and the pressure roller 14 are shown in detail in FIG. 2. The drive roller 12 is configured to axially displace a core rope 16 (which is retained on a spool 42). To enable the drive roller 12 to displace the core rope 16, the exemplary embodiment has the pressure roller 14 exerting pressure against the core rope 16 to press the core rope 16 against the drive roller 12, although the skilled person will know of other means and methods for engaging the core rope 16 with the drive roller 12. In the exemplary embodiment, the drive roller 12 comprises a 4 inch diameter drive wheel driven by a first motor 34 (behind the bracket 44 in FIG. 1 but illustrated in FIG. 9), the first motor 34 controlled by the PLC 38. In this exemplary embodiment, the first motor 34 is a 1000 steps stepper motor which drives the drive roller 12 by direct coupling. One pulse will rotate the drive roller 12 by 0.36 degrees, so to achieve 1 degree of rotation 2.7777 pulses are required. In the exemplary embodiment, 1 degree of rotation will generate 0.03488 inches of core rope 16 feed length. To achieve 0.10 inches of core rope 16 feed the drive roller 12 must rotate 2.8669 degrees, so the number of pulses required to achieve 0.10 inches of feed length is 7.96 pulses which can be rounded to 8 pulses per 0.10 inches feed.

The core rope 16 is held on the spool 42 and fed through a core rope feeding tube 46, after which the core rope 16 passes between the drive roller 12 and the pressure roller 14 and then into a further core rope feeding tube 46 before passing out of the inner space 82 of the housing 40 through the core rope aperture 48 and into the work space 84. With the core rope 16 in the work space 84

Figure 3A:
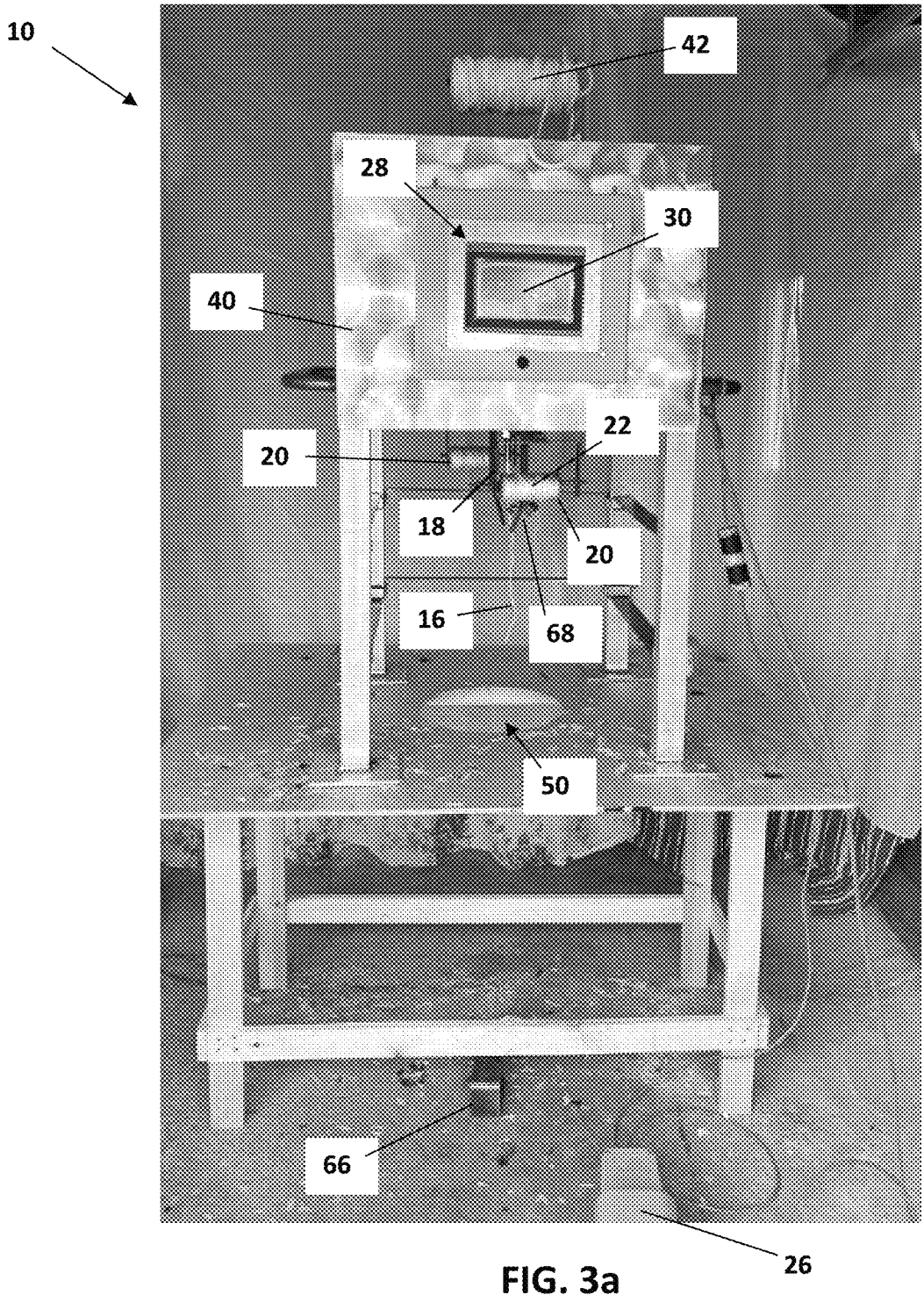
FIG. 3*a* is a front elevation view of the embodiment of FIG. 1 showing a foot pedal switch.
Figure 3B:
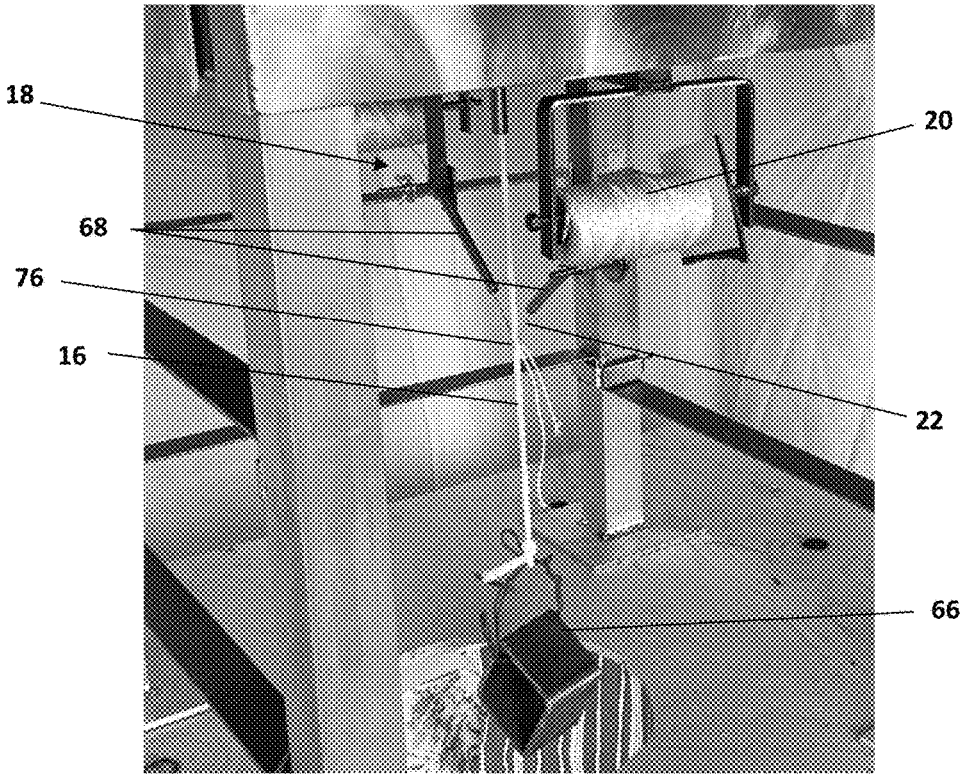
FIG. 3*b* is a front perspective view of the embodiment of FIG. 1 with a weight attached to the core rope to straighten and tension the core rope.
Figure 3C:
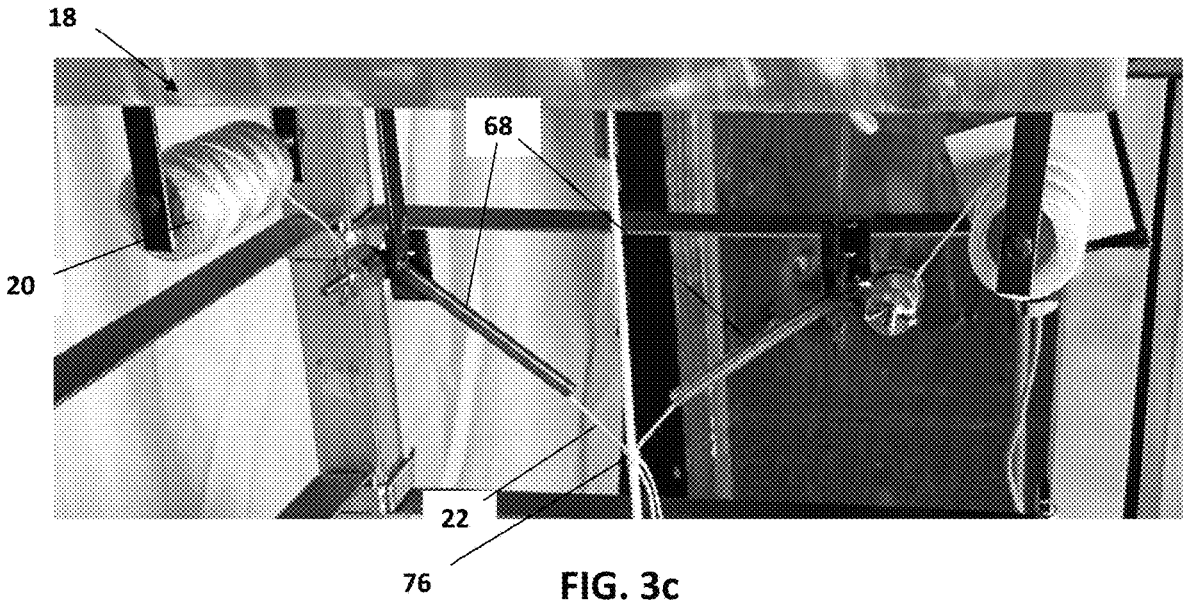
FIG. 3*c* is a detailed view of the rotating cross member.
Figure 9:
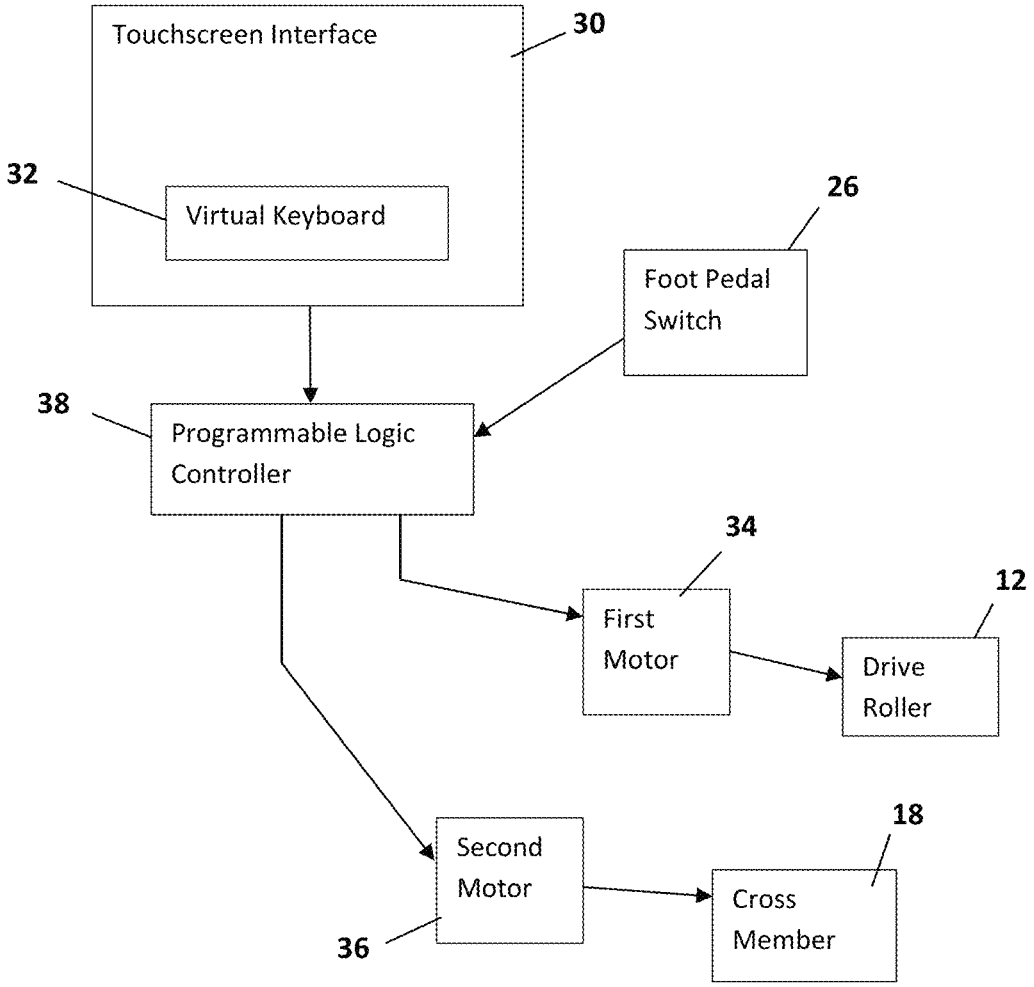
FIG. 9 is a simplified schematic illustrating components of an exemplary system according to the present invention.

Turning now to FIGS. 3*a* to 3*c*, the binding thread subsystem of the machine/system 10 (now with front panel in place, showing the user input device 28 and touchscreen 30, which touchscreen has a virtual keyboard 32 as shown in FIG. 9) is illustrated. In exemplary embodiments of the present invention, binding thread 22 is used to bind garland components 24 against the core rope 16. The machine/system 10 comprises a rotating cross member 18 mounted beneath the housing 40. The rotating cross member 18 supports at least one spool of the binding thread 22. While some embodiments may have a single spool 20, the exemplary embodiment has two spools 20 positioned at opposite ends of the cross member 18.

The cross member 18 is rotated beneath the housing 40 by means of a second motor 36 (shown in FIG. 1), again controlled by the PLC 38. The second motor 36 is again preferably a 1000 steps stepper motor as illustrated, with cross member 18 rotation using a 3:1 reduction gear system. The second motor 36 drives the 3:1 reduction gear to rotate the cross member 18. In this embodiment, every 3 rotations of the second motor 36 will rotate the cross member 18 one full rotation, where 3000 pulses are required to achieve one full rotation (360 degree) of the cross member 18.

With the core rope 16 positioned as desired by the operator (using either the touchscreen 30 or a foot pedal switch 26, as described below), and with a weight 66 at the bottom of the core rope 16 to straighten and tension the core rope 16, the cross member 18 can be rotated such that the spools 20 rotate around the core rope 16. As can best be seen in FIGS. 3*b* and 3*c*, the binding thread 22 passes through binding thread feed tubing 68 and is tied to the core rope at knot 76 and unspools from the spools 20 as the cross member 18 rotates around the core rope 16. The downward angle of the binding thread 22 as it meets the core rope 16 provides a beneficial orientation for binding of the garland components 24, as described below.

Figure 4:
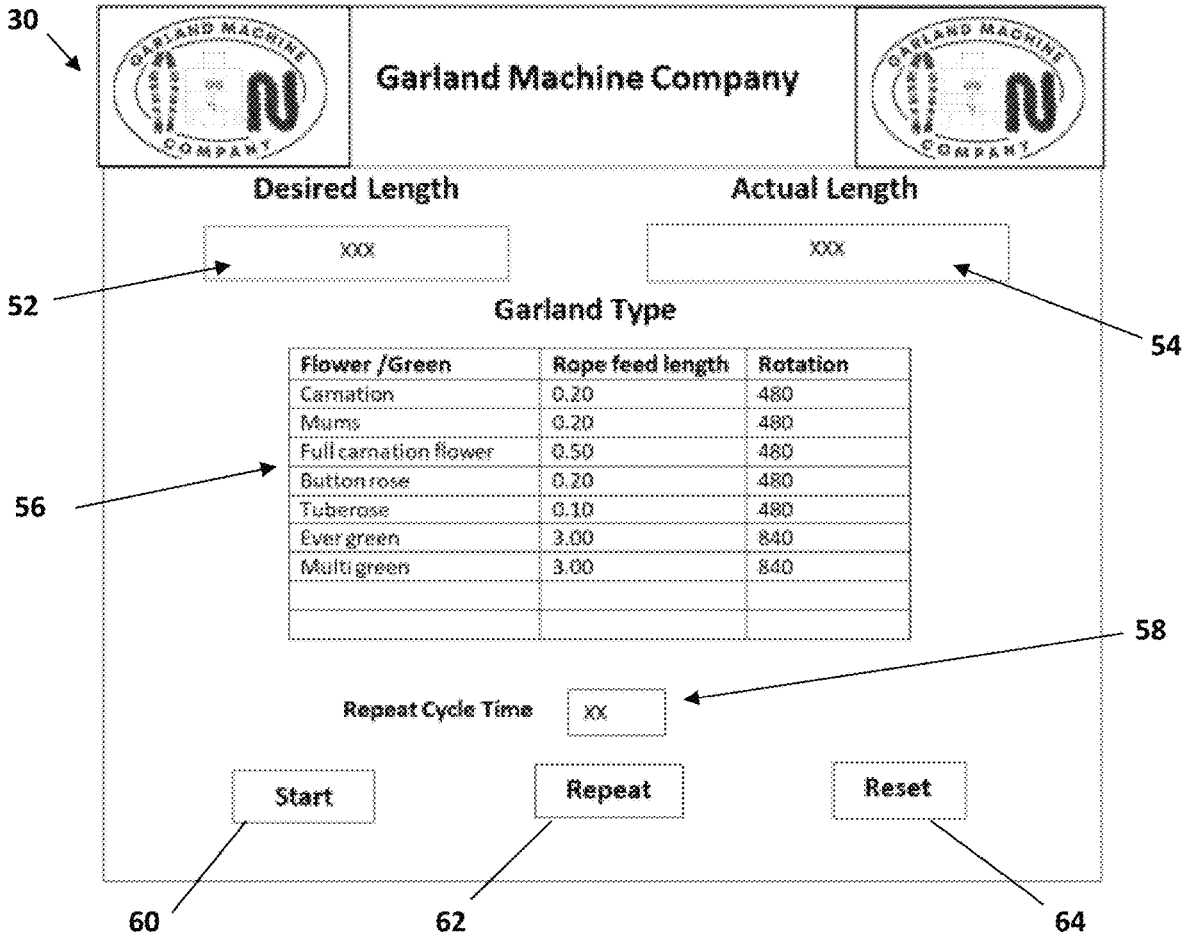
FIG. 4 is an exemplary control panel according to an embodiment of the present invention.

FIG. 4 illustrates an exemplary touchscreen 30 used with some exemplary embodiments of the present invention. Using the touchscreen 30 (which comprises a virtual keyboard that appears when data is being entered by the operator), the operator can enter a desired garland length at desired length input 52 which controls when the PLC 38 terminates the series of binding operations. The operator also selects the garland component 24 type at garland type input 56. As each garland component 24 type has a defined rope feed length (dictated in part by the size and type of the garland component 24) and defined degrees of rotation of the cross member 18 (again dictated in part by the size and type of the garland component 24), selecting the correct garland component 24 type aids in establishing a correct spacing of garland components 24 on the core rope 16 as the garland is formed. The operator can program the desired length and garland component 24 type details, or they can be entered as factory pre-sets by the manufacturer.

Figure 10A:
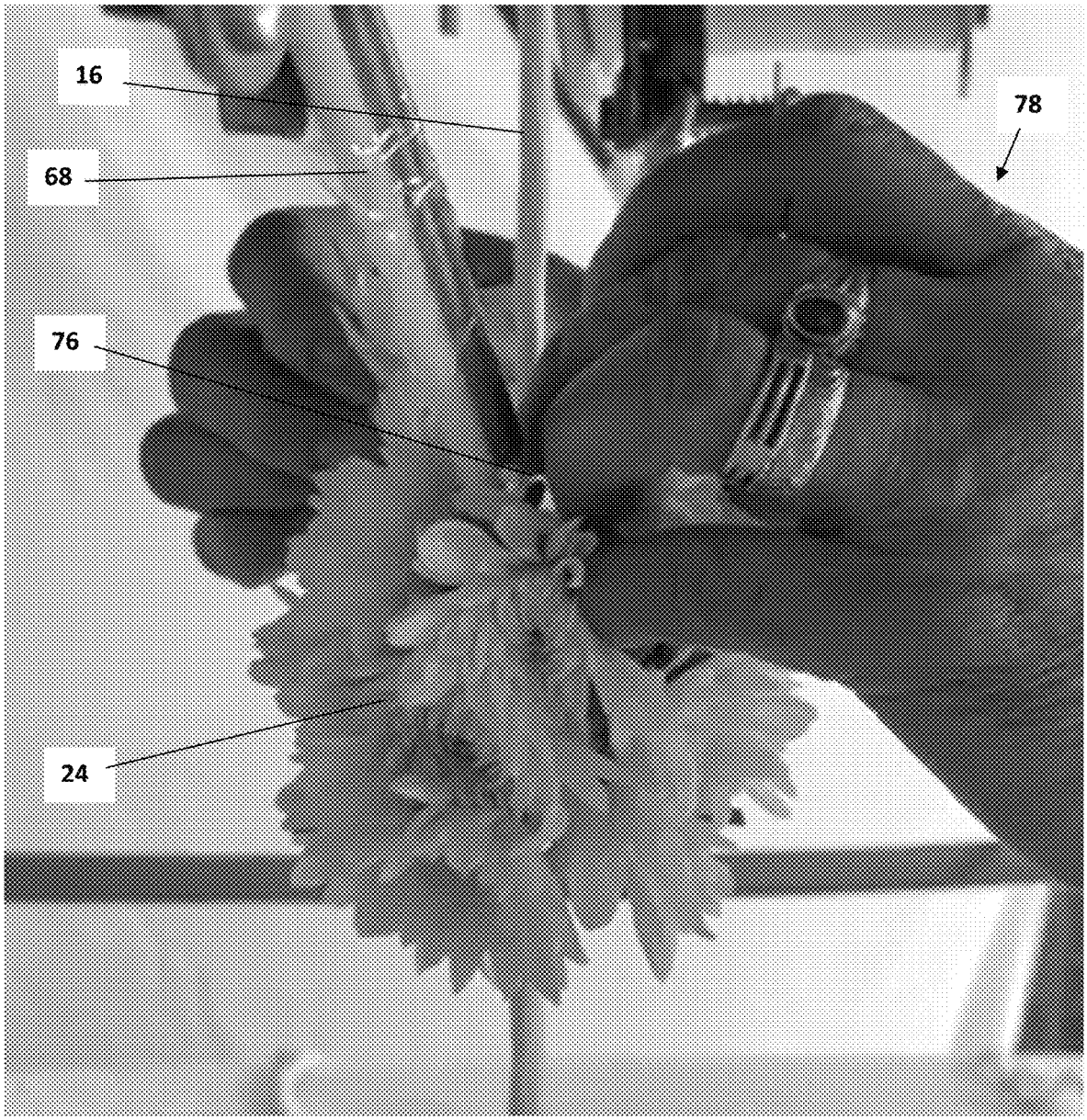
FIG. 10*a* shows an operator positioning garland components against the top of the binding thread knot beside the core rope.
Figure 10B:
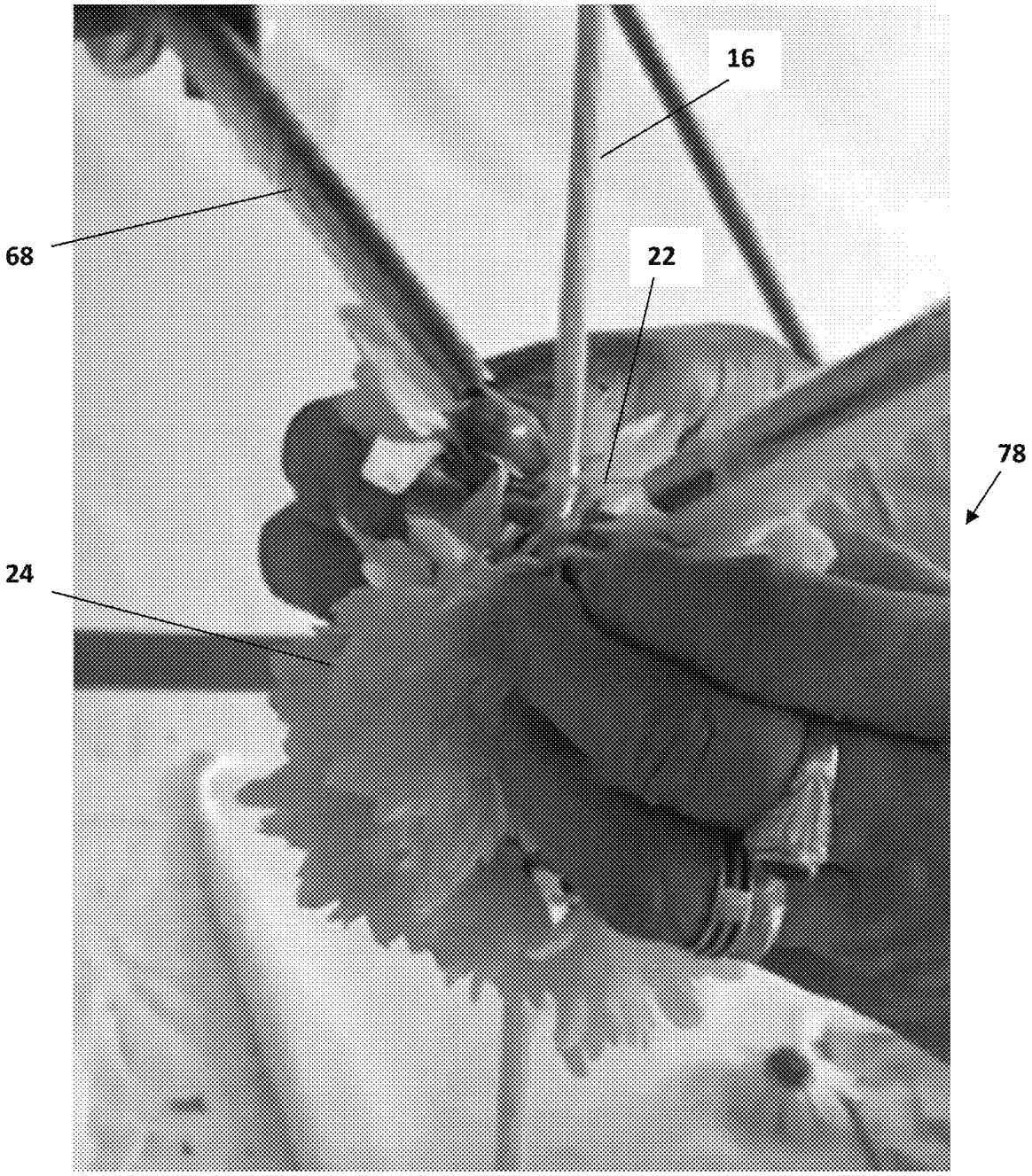
FIG. 10*b* shows the operator holding the garland components against the core rope as the binding thread is wound around the core rope to secure the garland components to the core rope.

To actuate the garland-tying steps, the operator can either press the foot pedal switch 26 or press the start button 60 on the touchscreen 30 (this can be set as a factory pre-set or set by the operator). This actuates a single cycle mode, in which a single garland component 24 is bound to the core rope 16, and the operator would need to repeatedly actuate subsequent binding cycles. By actuating the machine/system 10 in this manner, the PLC 38 is sent the signal to begin the garland-tying process. First, the PLC 38 instructs the first motor 34 to power the drive roller 12 to axially displace the core rope 16 to a first position, and after achieving the first position the displacement ceases, allowing the operator 78 to position garland components 24 against the knot 76 and the core rope 16, as illustrated in detail in FIG. 10*a*. The PLC 38 then instructs the second motor 36 to rotate the cross member 18 so the binding thread 22 is wound around the core rope 16 by the set degrees of rotation. As can be seen in FIGS. 10*a* and 10*b*, because the binding thread 22 is angled downwardly toward the core rope 16 by the binding thread feed tubing 68, it allows an operator 78 to hold the garland components 24 in place while the binding thread 22 is wrapped around the core rope 16.

Figure 5:
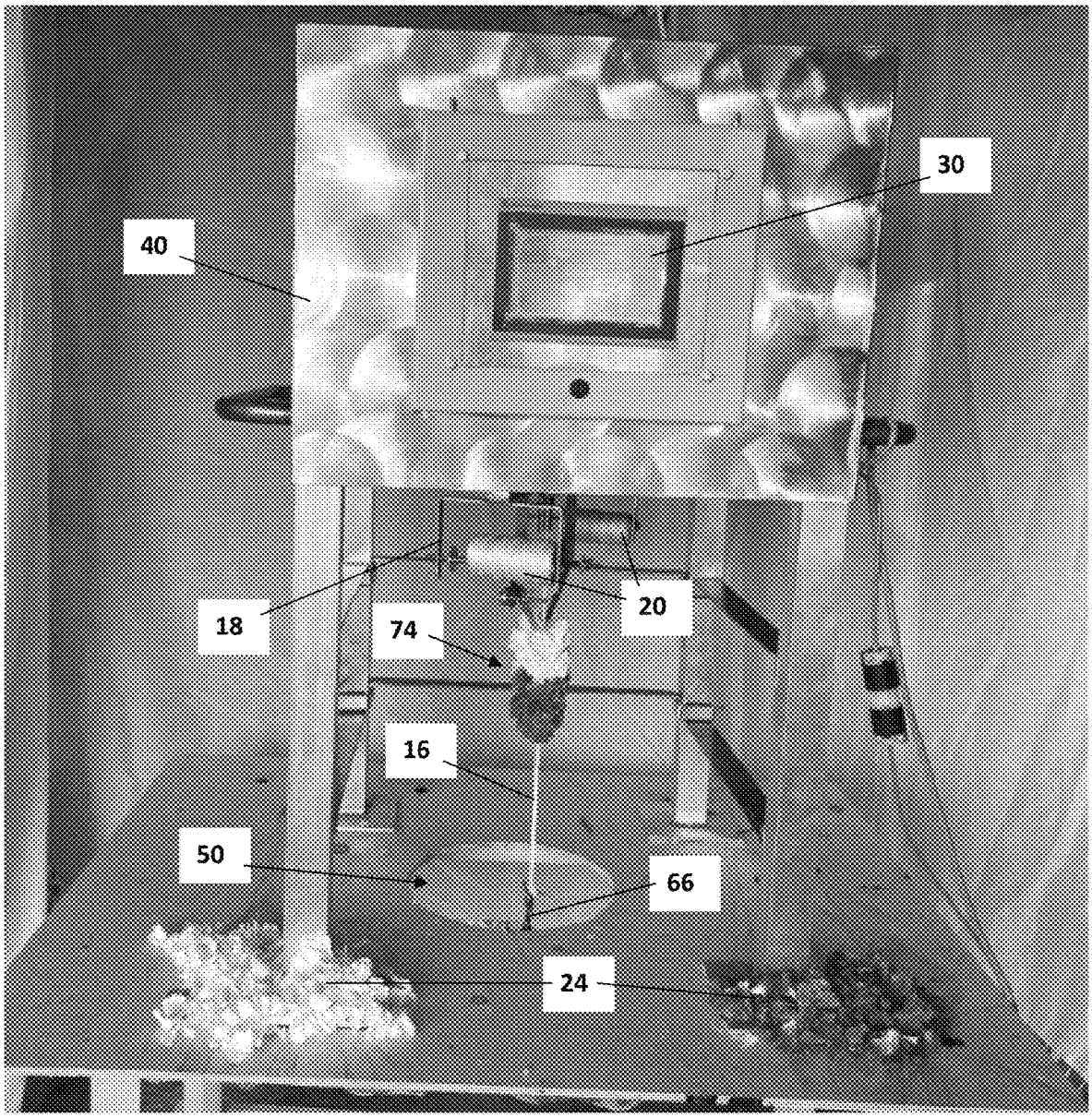
FIG. 5 is a front elevation view of the embodiment of FIG. 1 with a flower garland being formed.
Figure 6:
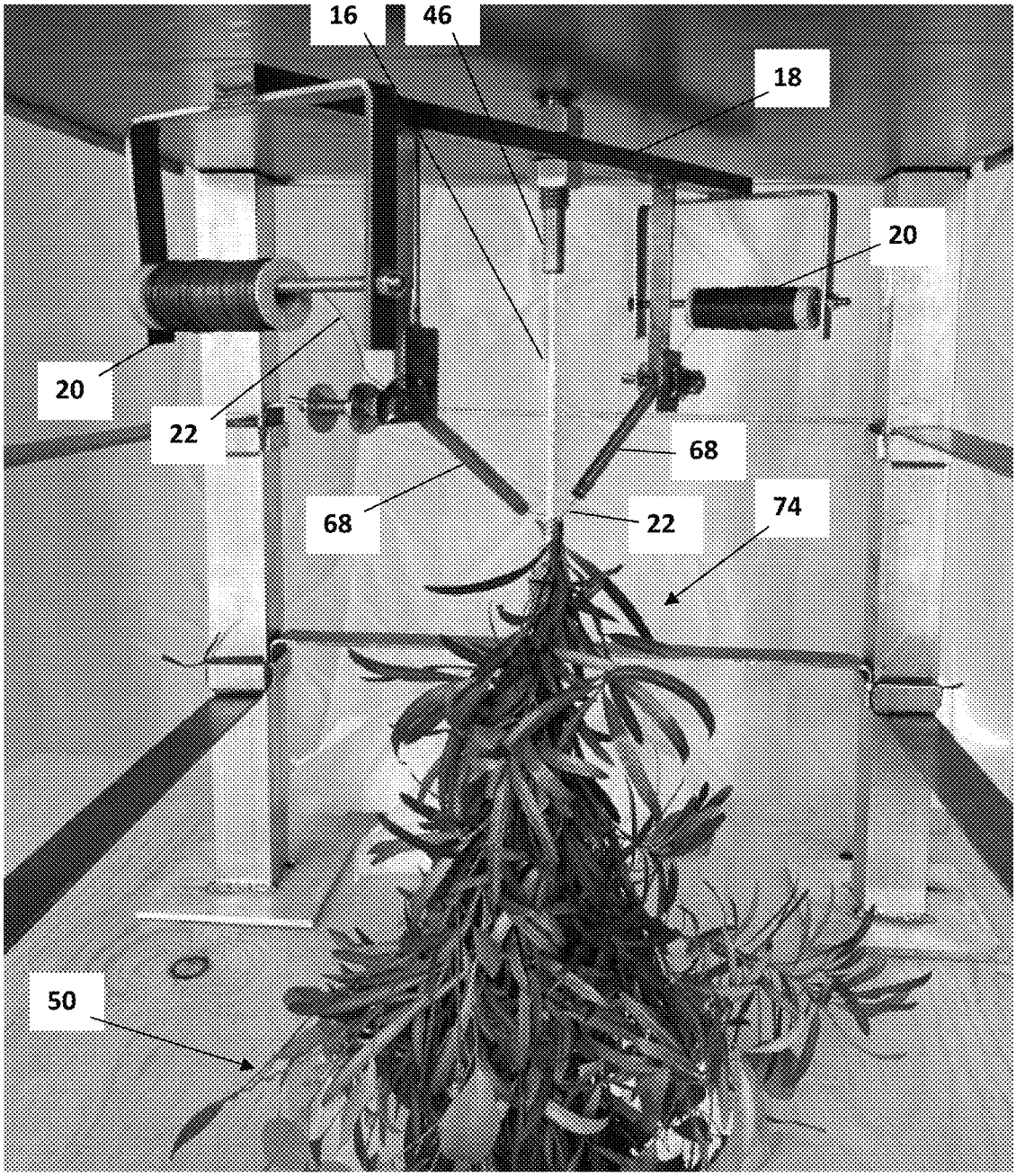
FIG. 6 is a front elevation view of the embodiment of FIG. 1 with a greenery garland being formed.

In this single cycle mode, the operator then actuates a second binding cycle (using the touchscreen 30 or the foot pedal switch 26), the PLC 38 instructing the first motor 34 to power the roller drive 12 to axially displace the core rope 16 to a second position (lower than the first position in the illustrated embodiment). With the second position achieved, the operator 78 positions a second garland component 24 against the knot 76 and the core rope 16, and the PLC 38 then instructs the second motor to rotate the cross member 18 so the binding thread 22 secures the second garland component 24 to the core rope 16 adjacent the first garland component 24. By this series of repeated binding cycles, the garland 74 begins to form as seen in FIG. 5. The actual garland length after each binding cycle is displayed at actual length display 54, as the PLC 38 is configured to calculate the current actual garland length based on number of cycles and rope feed length (from the garland type). FIG. 6 illustrates a greenery garland 74 being formed.

While the above single cycle mode may be used, the exemplary embodiment also enables an alternative repeating cycle mode. As can be seen in FIG. 4, the operator may select the repeat button 62 instead of the start button 60, thereby engaging the repeating cycle mode. In addition to the desired length and garland type, the operator enters a repeat cycle time at repeat cycle time entry 58, which defines the time period in seconds between binding cycles (selected to allow sufficient time for the operator to place the garland components 24 for binding, which would depend on such factors as garland type and operator experience). The binding cycles then repeat until the desired length is achieved, at which time the repeating cycles will cease. Axial displacement of the core rope 16 will be followed by a period selected for operator placement of the next garland component 24, after which the cross member 18 will be rotated the defined degrees of rotation to bind the garland component 24 to the core rope 16, followed by further axial displacement of the core rope 16, and so on until the desired garland length is achieved by the PLC 38 matching against the calculated actual length.

The touchscreen 30 comprises a reset button 64, which is used to reset the actual garland length in case the operator wishes to extend the length of the garland being formed beyond the original defined length.

Figure 7:
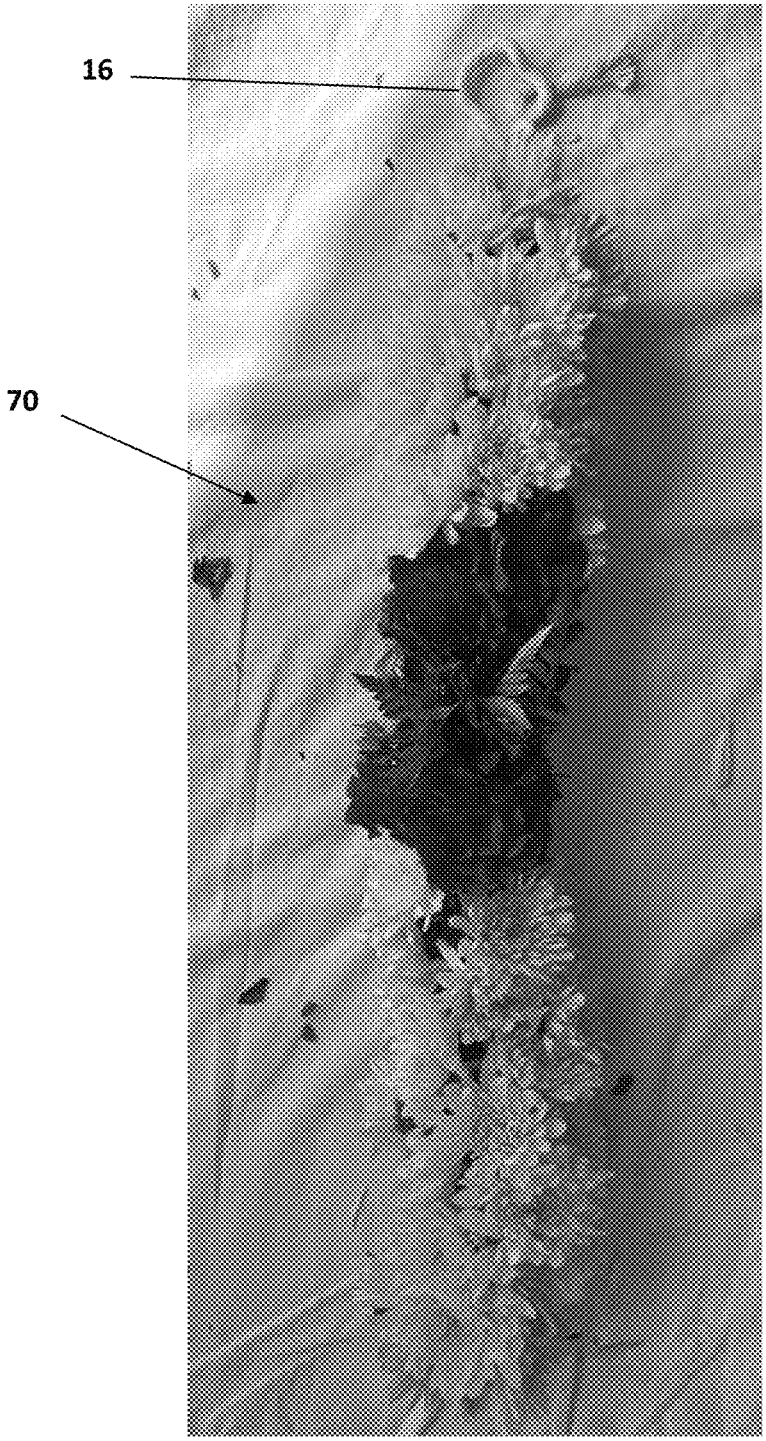
FIG. 7 is a garland formed of chrysanthemums using a machine in accordance with an embodiment of the present invention.
Figure 8:
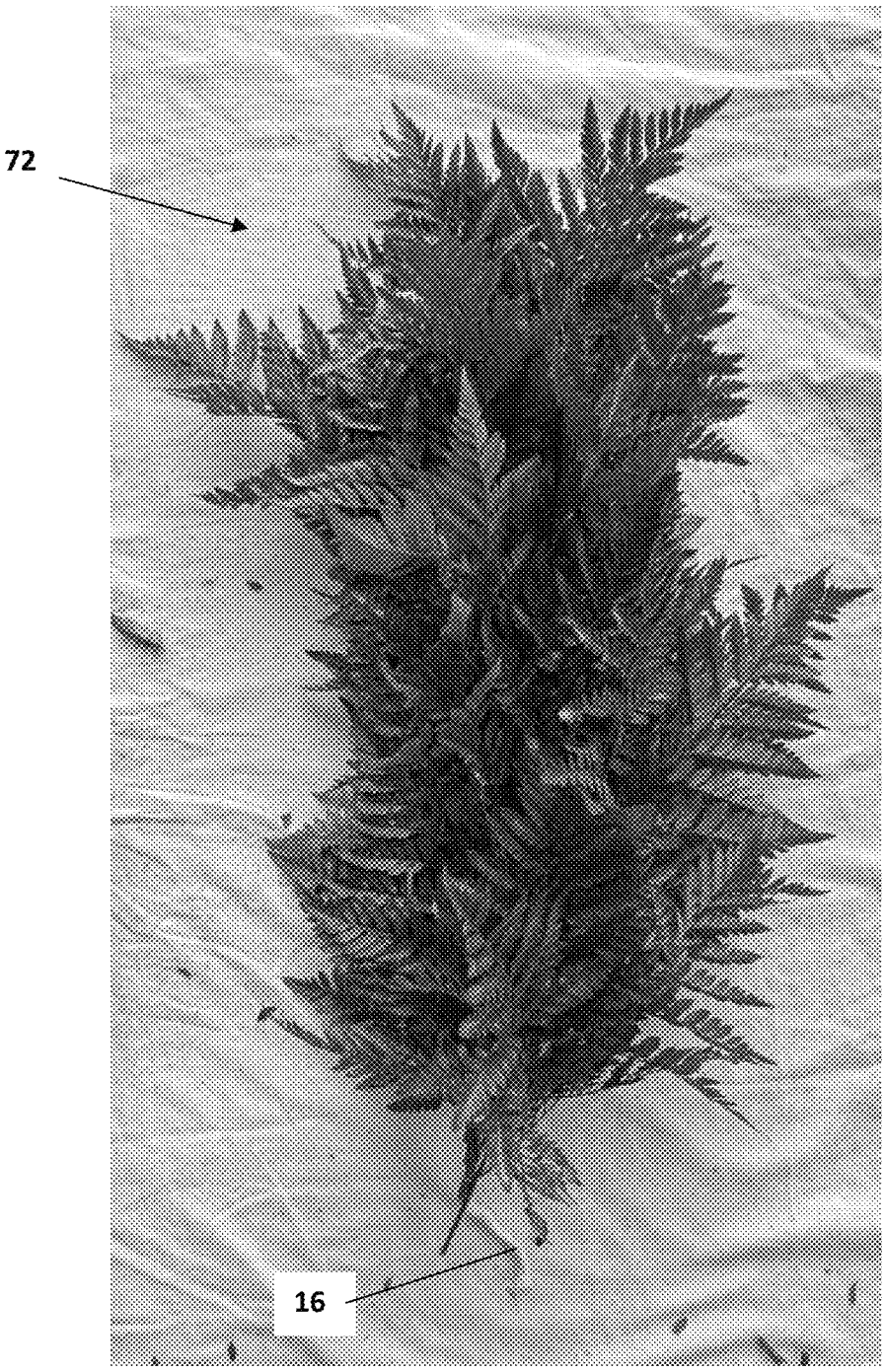
FIG. 8 is a garland formed of greenery using a machine in accordance with an embodiment of the present invention.

When the desired length is achieved, the garland has been formed and may be completed by severing the core rope 16 and the binding thread 22. FIGS. 7 and 8 illustrate completed chrysanthemum and greenery garlands 70, 72 with the garland components 24 secured to the core rope 16.

FIG. 9 is a schematic illustration of an exemplary embodiment of the present invention. The touchscreen interface 30 comprises a virtual keyboard 32, which the operator uses to send instruction signals to the PLC 38. Alternatively, the foot pedal switch 26 can be used to instruct the PLC 38. The PLC 38 is configured and programmed to send actuation signals to the first motor 34 and the second motor 36. The first motor 34 operates to rotate the drive roller 12 to axially displace the core rope 16 in a staged manner, while the second motor 36 operates to rotate the cross member 18 after axial displacement has ceased. As noted above, this binding cycle includes time for the operator to place garland components 24 and can be repeated until the desired garland length is achieved.

The foregoing is considered as illustrative only of the principles of the present invention. The scope of the claims should not be limited by the exemplary embodiments set forth in the foregoing, but should be given the broadest interpretation consistent with the specification as a whole.

The invention claimed is:

1. A system for forming a garland from a plurality of garland components, the system comprising:

a housing comprising a drive roller and a pressure roller and at least portion of a first feeding tube and at least a portion of a second feeding tube;

a first spool disposed above the housing and configured to supply a core rope;

wherein the core rope is configured to be fed from the first spool, through the first feeding tube, and between the drive roller and the pressure roller, whereby it is retained between the drive roller and the pressure roller at a first position;

wherein the second feeding tube is disposed below the drive roller;

a rotating cross member disposed beneath the housing and configured to rotate about a first axis;

a second spool supported by the rotating cross member, the second spool configured to supply a first binding thread;

wherein the rotating cross member is configured to rotate the second spool around the core rope, thereby winding the first binding thread around a first portion of the core rope to secure one of the plurality of garland components against the core rope; and the drive roller configured to move the core rope from the first position to a second position axially spaced from the first position, enabling the rotating cross member to rotate the second spool around a second portion of the core rope to wind the first binding thread around the second portion of the core rope to secure another of the plurality of garland components against the core rope adjacent the one of the plurality of garland components, thereby forming the garland.

2. The system of claim 1 further comprising:

a first motor configured power the drive roller to displace the core rope; and a second motor configured power the rotating cross member.

3. The system of claim 2 further comprising an actuator configured to actuate the first motor and the second motor.

4. The system of claim 3 wherein the actuator comprises a foot pedal switch in communication with the first motor and the second motor.

5. The system of claim 2 wherein the first motor is a stepper motor directly coupled to the drive roller.

6. The system of claim 2 wherein the second motor is a stepper motor.

7. The system of claim 3 wherein the actuator comprises a user input device and a controller, the user input device configured to allow a user to input a garland component type and a desired garland length, wherein the garland component type defines a core rope feed length between adjacent garland components and a second spool rotation degrees, and the controller configured to instruct the first motor and the second motor.

8. The system of claim 1 wherein the system further comprises a third spool supported by the rotating cross member and configured to supply a second binding thread, wherein the second spool and the third spool are supported at opposite ends of the rotating cross member and are capable of simultaneously winding the first binding thread and the second binding thread around the core rope.

9. The system of claim 1 wherein the plurality of garland components are selected from the group consisting of flowers, greenery and a combination thereof.

10. The system of claim 1, wherein the core rope is retained under pressure between the drive roller and the pressure roller.

11. The system of claim 3, wherein the system is operable in a single cycle mode wherein activation of the actuator rotates the second spool around the core rope, thereby winding the first binding thread around the core rope to secure the one of the plurality of garland components against the core rope, and displaces the core rope to the second position.

12. The system of claim 3, wherein the system is operable in a repeating cycle mode wherein activation of the actuator repeats a cycle of rotating the second spool around the core rope and displacing the core rope.

* * * * *